United States Patent [19]

Lyles

[11] Patent Number: 4,795,358

[45] Date of Patent: Jan. 3, 1989

[54] MOTION ACTUATED CONNECTOR APPARATUS

[75] Inventor: John C. Lyles, Fort Mill, S.C.

[73] Assignee: Multi-Shifter, Inc., Charlotte, N.C.

[21] Appl. No.: 83,598

[22] Filed: Aug. 7, 1987

[51] Int. Cl.[4] ..... H01R 13/629; H01R 13/64

[52] U.S. Cl. ..... 439/247; 320/2; 403/13; 439/376

[58] Field of Search ..... 320/2; 439/246–252, 439/296–298, 310, 338, 341–343, 376; 403/13, 14

[56] References Cited

U.S. PATENT DOCUMENTS

| | | | |
|---|---|---|---|
| 3,111,355 | 11/1963 | Samburoff et al. | 439/159 |
| 3,309,235 | 3/1967 | Teeple, Sr. | 429/98 |
| 3,529,229 | 9/1970 | Kennedy | 320/2 |
| 3,596,018 | 7/1971 | Elmes | 320/2 |
| 3,603,860 | 9/1971 | Johnson | 320/2 |
| 3,964,814 | 6/1976 | Kalbitz et al. | 439/248 |
| 3,986,095 | 10/1976 | Nakai et al. | 320/2 |
| 4,647,129 | 3/1987 | Kandybowski et al. | 439/246 |

*Primary Examiner*—Gil Weidenfeld
*Assistant Examiner*—Gary F. Paumen
*Attorney, Agent, or Firm*—James B. Hinson

[57] ABSTRACT

Apparatus and methods for aligning, mating and unmating connectors as a result of relative motion between apparatus operatively associated with the two parts of the connector is disclosed. Specifically, as the apparatus operatively associated with the two parts of the connector move with respect to each other, the parts of the connector move along at least first and second angularly displaced paths to align, mate and unmate the connector as a result of such motion.

4 Claims, 4 Drawing Sheets

MOTION ACTUATED CONNECTOR APPARATUS

BACKGROUND OF THE INVENTION

1. Field of the Invention

The invention relates to motion actuated connectors and more specifically to connectors useful with systems for moving a storage battery between the use position and a charging station.

2. Background of the Invention

Efficient utilization of battery powered vehicles requires that the battery be removed from the vehicle for charging. In the prior art systems it was conventional practice in removing batteries from vehicles such as fork lift trucks to manually unplug the battery connector from the vehicle, load the battery on a suitable transport mechanism, transport the battery to the charger and manually connect the battery to the charger. Such a procedure was both time consuming and inefficient. For example, such a process required the operator to first position the transport mechanism such that the battery could be removed from the vehicle. With the transport vehicle so positioned, the operator dismounted the transport vehicle and manually disconnected the battery connector. The battery was loaded and transported to the charge station where it was necessary to manually connect the battery to the charger. An inverse sequence of operations was necessary to transport the charged battery from the charging station to the vehicle. In summary, if the task was to be performed by one worker it was necessary for the worker to mount and dismount the transport vehicle at least three times in order to move a battery between the vehicle and a charging station.

3. Discussion of the Prior Art

A prior art search was conducted prior to the preparation of this patent application. The search was concentrated on the location of prior art related to push-pull mechanism useful for mating and unmating electrical connectors used in conjunction with systems using storage batteries and similar electrical power sources.

During the above described search, a wide variety of prior art patents were located, as more specifically discussed below.

U.S. Pat. No. 3,111,355 discloses a connector device specifically designed to disconnect components of rocket vehicles or similar vehicles.

U.S. Pat. Nos. 3,937,636; 4,331,749; 4,637,965 and 3,309,235 illustrate various types of connectors specifically designed for use with storage batteries.

Other electrical connectors not specifically designed for connecting and disconnecting battery operated power sources are illustrated in U.S. Pat. Nos. 4,508,404; 1,571,222 and 4,534,605.

None of the above-discussed prior patents disclose or suggest the method of operating battery powered systems using the techniques and apparatus disclosed in this patent application.

SUMMARY OF THE INVENTION

The preferred embodiment of the invention provides apparatus for moving first and second portions of an electrical connector with respect to each other such that the connector is selectively mated and unmated as a result of the motion. Specific applications of the invention include systems in which it is desired to move storage batteries between a vehicle and a charging station without requiring that the battery connectors be manually mated and unmated. In such applications, the connector includes at least first and second portions. The first portion is mounted on one surface of the battery with the second portion of the connector being duplicated at the vehicle and the charging station.

In the preferred embodiment, the apparatus includes first means for supporting a first portion of the connector on a battery. The second portion of the connector is duplicated at the vehicle and the charging station and is supported by push-pull means for moving the portions of the connector into the mated and unmated positions as the battery is moved into or removed from either the vehicle or the charging station. Alignment means is provided with cooperates with the push-pull apparatus to selectively move the first and second portions of the connector along at least first and second angularly displaced paths to align the first and second portions of the connector as the push-pull means moves the portions of the connector between the unmated and mated positions. The apparatus is designed such that the connector will be mated when the battery is positioned either in its normal use position in the vehicle or in its normal charge position in the charging station. Removing the battery from either the vehicle or the charging station to the transport vehicle automatically disconnects the connector as the push-pull means moves the portions of the connector to the unmated position. Similarly, moving the battery into either the normal use position in a vehicle or the normal charge position in the charging station automatically moves the portions of the connector into the mated position.

OBJECTS OF THE INVENTION

The principal object of the invention is to provide improved means for moving a storage battery between its use position and a charging station.

Another object of the invention is to provide means for supporting first and second portions of a connector such that they can be mated and unmated by selectively moving the portions of the connector with respect to each other.

Another object of the invention is to provide means for moving at least one portion of a connector having at least two portions along at least first and second angularly displaced paths such that said portions are aligned, mated, and unmated by such motion.

DETAILED DESCRIPTION

Figure 1:
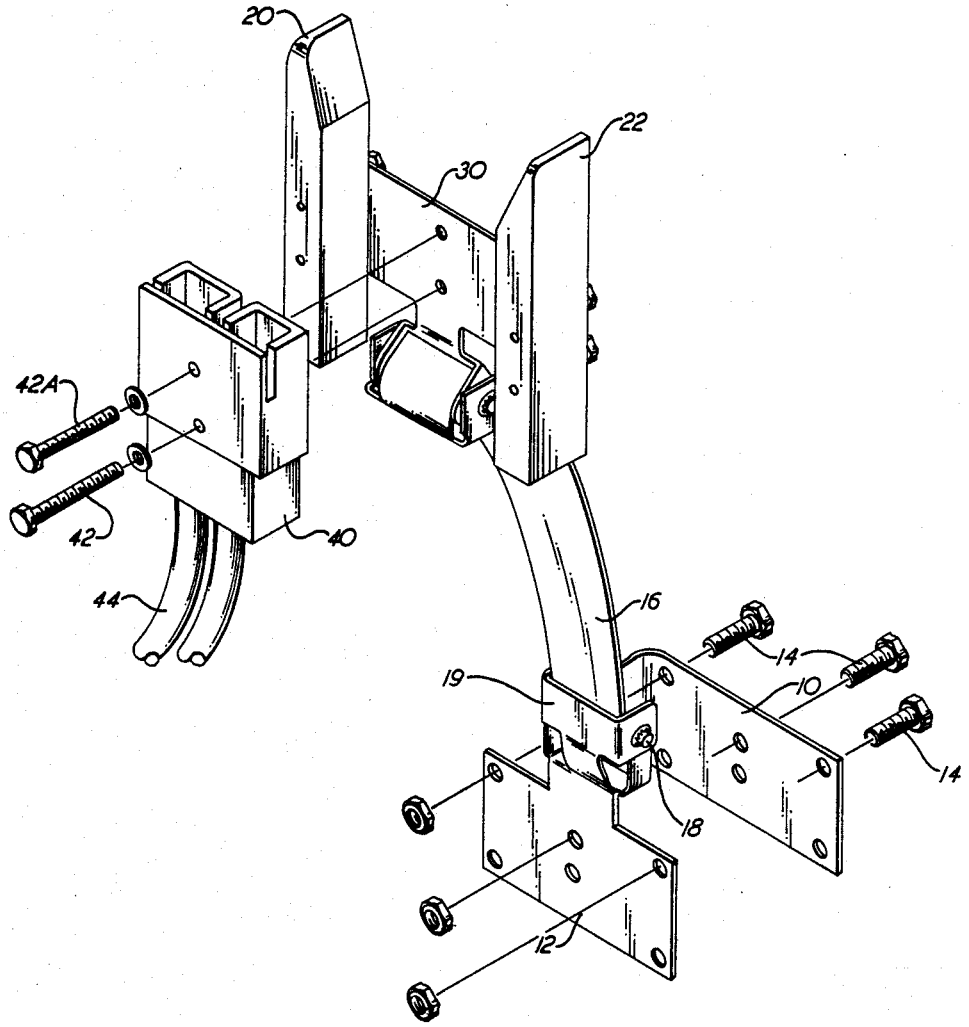
FIG. 1 is an isometric drawing illustrating portions of a connector, the push-pull apparatus, and the alignment apparatus.

The method comprising an embodiment of the invention utilizes means for supporting at least first and second portions of an electrical connector such that the first and second portions move along first and second angularly displaced paths such that the portions are mated and unmated by such motion. This embodiment of the invention is specifically intended to use with apparatus for moving storage batteries between battery powered vehicles, such as fork lift trucks, and a battery charging station.

The preferred apparatus also comprising an embodiment of the invention and useful in practicing the above described method for mating and unmating a connector includes push-pull means, alignment means and means for supporting the second portion of the connector, preferably duplicated on the vehicle and at the battery charging station. In such case, a suitable mounting plate 10 is attached to both the vehicle and the battery charging station.

Mounting apparatus for the push-pull mechanism includes a bracket 12 which can be attached to the mounting plate 10 using any convenient means such as conventional bolts illustrated at reference numeral 14. The mounting plate 10 is attached to the vehicle or the charging station utilizing a structural member 11. A resilient curved spring member 16 is attached to the mounting bracket 12 using a suitable pin 18 passing through an eye positioned at one end of spring 16 and jaws on bracket 12. Rotary motion between the mounting bracket 12 and the spring member 16 is limited to approximately 90° by rotary motion limiting clip 19.

First and second spaced apart alignment bars 20 and 22 are attached to an alignment bar mounting bracket 30 using any convenient means such as conventional bolts 32A through 32D. Means for attaching the alignment bracket 30 to the spring 16 is provided by a mating hinge portion comprising jaws and an eye respectively forming a portion of the bracket 30 and the spring 16 with these two members secured in fixed relationship to each other by a hinge pin 31. The first portion 40 of the connector is attached to the alignment bracket 30 using conventional bolts 42 and 42A. A cable 44 is coupled to either the vehicle or the charging station depending on the use.

Figure 2:
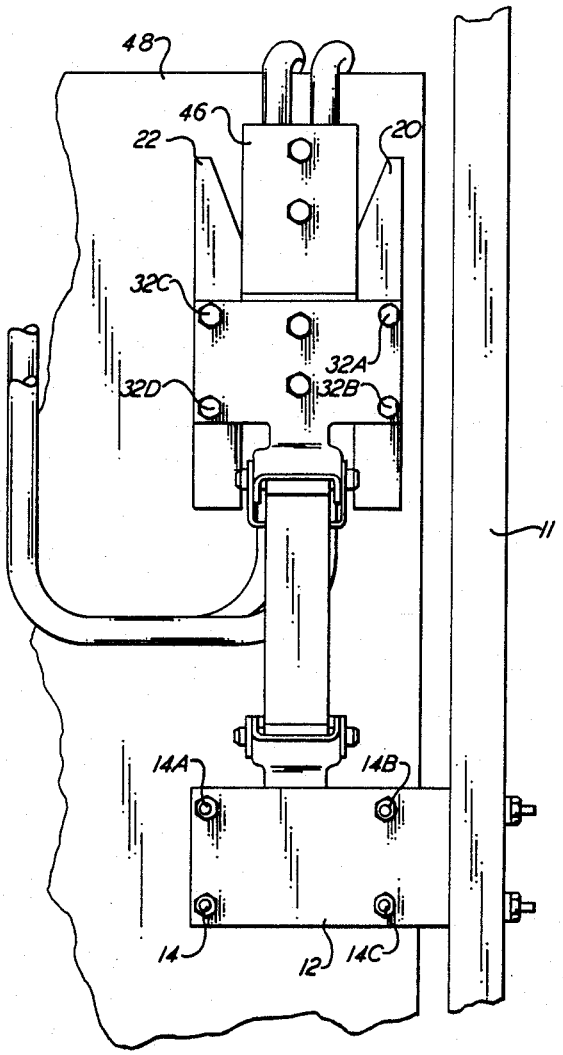
FIG. 2 is a drawing illustrating the front view of the push-pull apparatus and a connector in the mated position.
Figure 3:
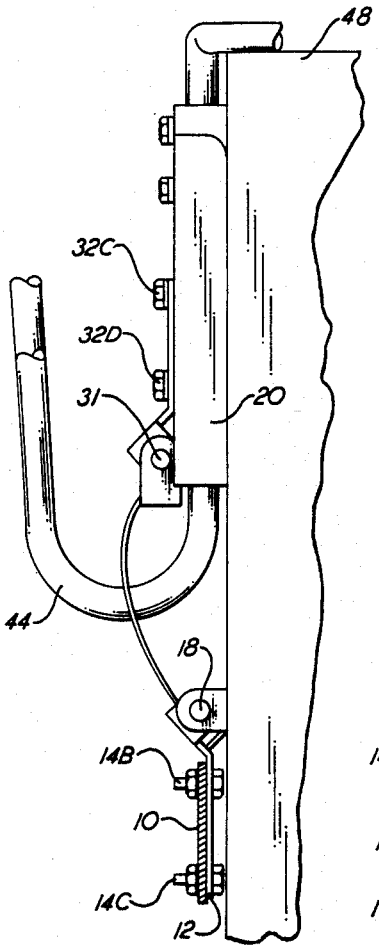
FIG. 3 is a side view illustrating the push-pull apparatus and a connector in the mated position.

In the preferred embodiment, the second portion 46 of the connector (FIG. 2) is attached to the side of a battery 48. The connector is shown in the fully mated position in FIG. 3.

Figure 4:
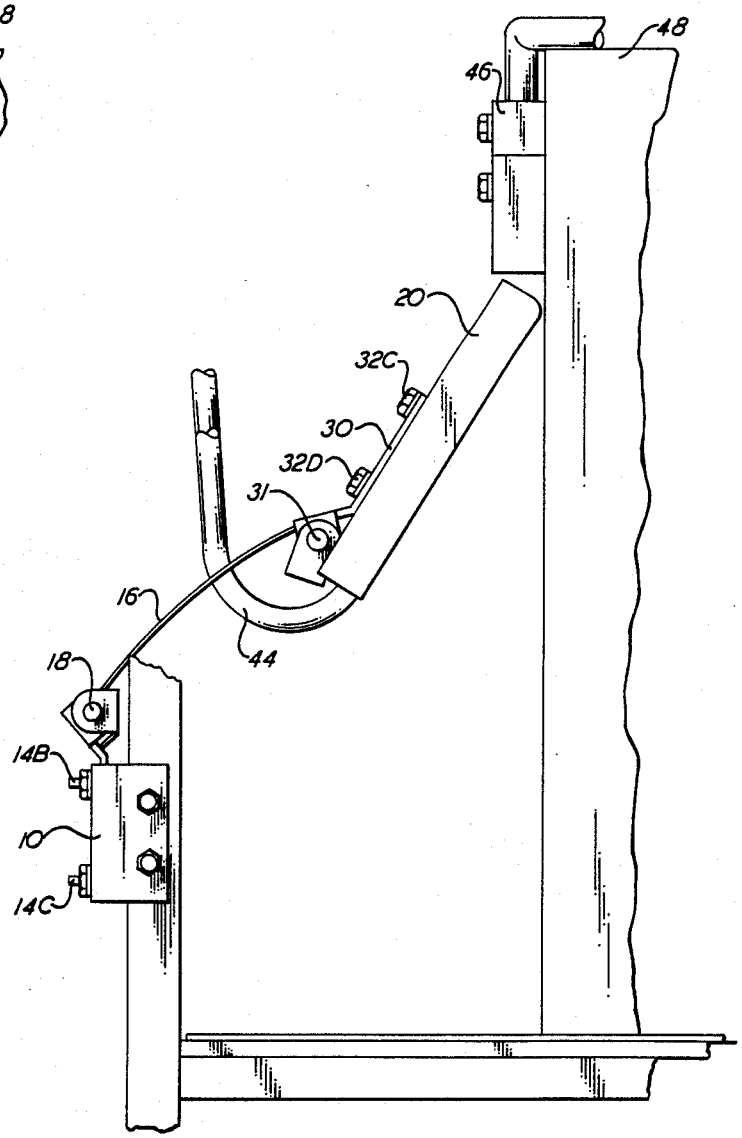
FIG. 4 is a drawing illustrating the alignment of the push-pull apparatus as contact with the battery is established.
Figure 5:
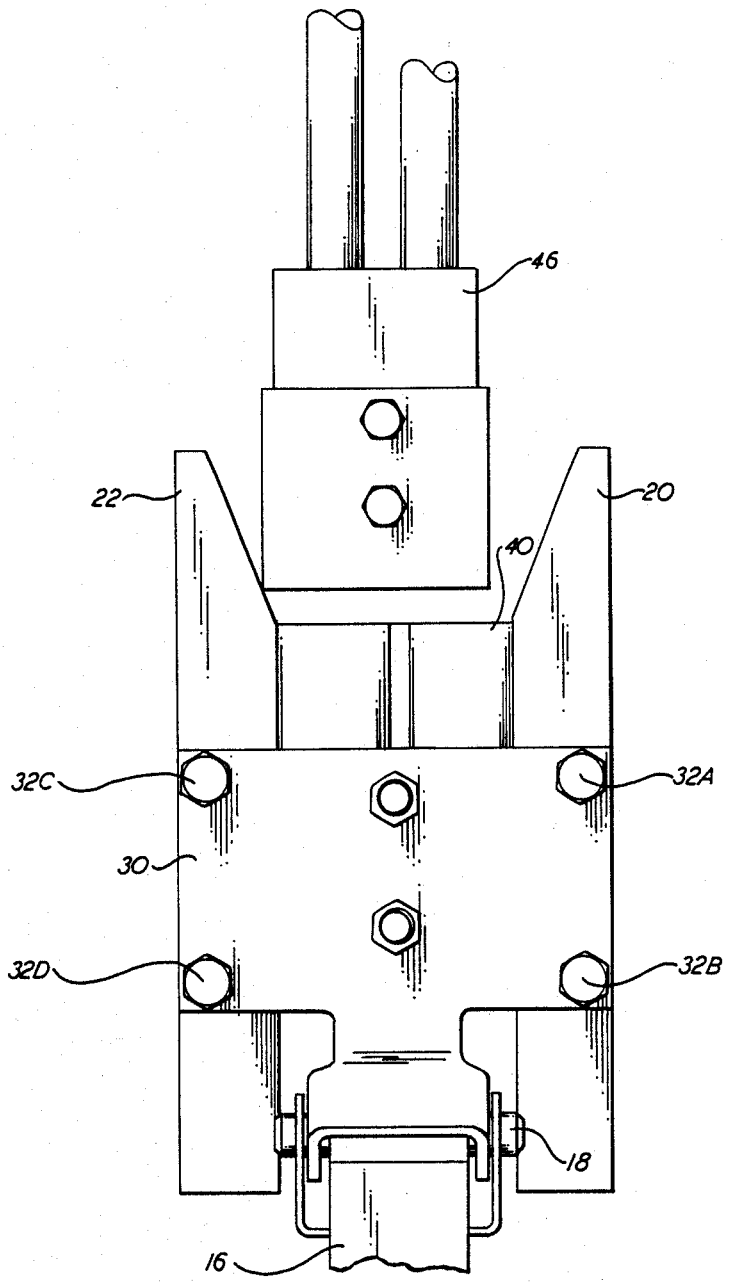
FIG. 5 is a second drawing further illustrating the alignment bars and their use to align the first and second portions of the connector.

More specifically, as the battery 48 is moved toward either the vehicle or the charging station the upper rounded portion of the alignment bars 20 and 22 contacts the surface of the battery 48 as illustrated in FIG. 4. As the movement of the battery continues, the alignment bars 20 and 22 rotate about pin 31 causing the connector to reposition such that it is substantially parallel to the surface of the battery 48. Further movement causes the connector to slide upward and to become positioned substantially parallel to the surface of the battery 48. Additionally, the outwardly slopping inner edges of the alignment bars contact the side portion of the second part 46 of the connector. As the motion of the battery continues the portions of the connector 40 and 46 move into alignment with further motion between the battery and the test station, moving the connector into the mated position. Should the connector parts fail to mate for any reason, the spring 16 bends preventing damage to the connector and other apparatus. In fact, if the hinge pins move past each other the alignment bars pop-out removing all pressure from the connector parts and the push-pull apparatus. The spring 16 is designed to limit the maximum pressure between the components of the connector if the connector fails to mate properly.

Disconnecting or unmating the connector for purposes of removing the battery is an inverse process of the mating operation discussed above. That is, as the battery and the vehicle are moved apart, the lower end of spring 16 moves outwardly, exerting a force downwardly on the lower half 40 of the connector. This causes the first and second portions 40 and 46 of the connector to move away from each other with the motion being sufficient to totally disconnect the connector.

As previously discussed, the disclosed preferred embodiment of the invention was developed for use in conjunction with equipment for moving batteries between battery powered vehicles and a charging station. All components of the apparatus can be constructed using commercially available material and techniques. However, materials such as nylon, which is tough, has low friction characteristics and is resistant to battery acid, are useful for the alignment bars 20 and 22. Also, the connector used in the developmental model was a type SB 350- G 320 available from Anderson Power Products, Inc. Conventional spring steel is usable for the spring member 16. All the other components can be made of any material which provides the required rigidity and strength. All components subject to corrosion by battery acid are preferably coated to reduce such corrosion.

From the above operation, it is clear that the apparatus which is the subject of this invention provides a convenient means whereby batteries can be disconnected, moved, and reconnected. This mode of operation is particular useful in manufacturing operations where it is desired to conveniently and quickly install freshly charged batteries in a wide variety of battery powered vehicles at the end of each work shift. Such operation can be conveniently accomplished using the apparatus discussed above.

Although the apparatus and method which are the subject of the present invention were specifically designed and developed for use in conjunction with battery changing equipment, it is obvious that the apparatus is useful in coupling and uncoupling other devices. The only requirements are that the device be adapted to be coupled and uncoupled by applying preselected forces between the components to be coupled together, and that at least one of the components be sufficiently flexible to permit the alignment of the components with respect to each other, as described above.

Although the preferred embodiment described above moves the connector along a vertically positioned edge of the battery as the connector is mated and unmated, other orientations of the apparatus may be used. In the vertical orientation, gravity causes the apparatus to position itself as illustrated in FIG. 1. Other orientations may require that the knuckle joints associated with the leaf spring 16 by spring loaded to position in the proper orientation when the connector is in the unmated position.

I claim:

1. Apparatus for moving at least first and second portions of an electrical connector with respect to each other such that the parts of the connector are selectively aligned, mated and unmated as a result of motion between the parts of the connector, comprising in combination:

(a) first means operatively associated with said connector for supporting at least said first portion of said connector;

(b) second means operatively associated with said connector for supporting at least said second portion of said connector;

(c) third push-pull means adapted to move said first and second portions of said connector between mated and unmated positions;

(d) fourth alignment means cooperating with said first, second and third means to at least selectively move said first and second means operatively associated with said first and second portions of said connector such that said first and second portions of said connector move, as required, with respect to each other along at least first, second, and third, angularly displaced axes to align said first and second portions of said connector as said push-pull means moves said first and second portions of said connector with respect to each other such that said first and second portions of said connector move between the unmated position and the mated positions as a result of such motion;

(e) wherein said second means includes a first bracket having a surface adapted to support said first portion of said connector, first and second substantially parallel jaws adapted to cooperate with said push-pull means to provide a first knuckle joint permitting said bracket to selectively rotate with respect to said push-pull means;

(f) wherein said push-pull means includes a second bracket adapted to be affixed to said means operatively associated with said first portion of said connector, said second bracket including at least a pair of opposed jaws cooperating with an eye in the end of a leaf spring an a pin to form a second knuckle joint with said second bracket, said first knuckle joint being joined to the other end of said leaf spring by means of a pin, whereby moving said means operatively associated with said first and second portions of said connector causes said first and second portions of said connector to move into alignment and into the mated position or into the unmated position, as desired, as a result of such motion.

2. Apparatus in accordance with claim 1 wherein said first knuckle joint includes first restraining means for restraining the motion of said first knuckle joint to a predetermined range.

3. Apparatus in accordance with claim 2 further including second rotary restraining means adapted to restrain the motion of said second knuckle joint to a predetermined range.

4. Apparatus in accordance with claim 2 wherein said predetermined range is approximately 90°.

* * * * *